US006009563A

United States Patent [19]

Swanson et al.

[11] Patent Number: 6,009,563

[45] Date of Patent: Jan. 4, 2000

[54] SPORTS SAFETY HELMET

[76] Inventors: David A. Swanson, 2224 Athens Ave., Simi Valley, Calif. 93065; Greg White, 1566 Muir St., Fillmore, Calif. 93015

[21] Appl. No.: 09/083,919

[22] Filed: May 26, 1998

[51] Int. Cl.[7] ..... A42B 3/30

[52] U.S. Cl. ..... 2/425; 2/422; 2/425; 362/105; 455/90; 455/100; 455/351

[58] Field of Search ..... 2/410, 411, 5, 2/422, 424, 425, 421; 362/105, 106; 455/568, 90, 100, 79, 575, 351

[56] References Cited

U.S. PATENT DOCUMENTS

| | | | |
|---|---|---|---|
| 3,586,977 | 6/1971 | Lustig | 455/351 |
| 3,916,312 | 10/1975 | Campbell | 455/575 |
| 4,077,007 | 2/1978 | McKinney . | |
| 4,130,803 | 12/1978 | Thompson . | |
| 4,321,433 | 3/1982 | King | 455/344 |
| 4,357,711 | 11/1982 | Drefko et al. . | |
| 4,471,174 | 9/1984 | Nava | 379/430 |
| 4,533,984 | 8/1985 | Gatton | 362/232 |
| 4,607,395 | 8/1986 | Sundahl . | |
| 4,638,410 | 1/1987 | Barker . | |
| 4,817,212 | 4/1989 | Benoit | 2/209.2 |
| 4,833,726 | 5/1989 | Shinoda et al. | 455/89 |
| 5,142,700 | 8/1992 | Reed | 455/344 |
| 5,207,500 | 5/1993 | Rios et al. . | |
| 5,365,615 | 11/1994 | Piszkin . | |
| 5,448,780 | 9/1995 | Gath . | |
| 5,477,566 | 12/1995 | Massman . | |
| 5,615,410 | 3/1997 | DeMars | 455/90 |
| 5,678,205 | 10/1997 | Gray | 455/90 |

FOREIGN PATENT DOCUMENTS

| | | | |
|---|---|---|---|
| 2630603 | 10/1989 | France . | |
| 1591711 | 6/1981 | United Kingdom . | |
| 94/02043 | 2/1994 | WIPO | 2/422 |

OTHER PUBLICATIONS

1998 Catalog from the Hobie Company, describing a sailing helmet.

*Primary Examiner*—Michael A. Neas
*Attorney, Agent, or Firm*—Richard C. Litman

[57] ABSTRACT

A sports safety helmet includes two way radio communications and integral external lighting. The helmet is particularly well adapted for use in sailing, where head protection from swinging booms, heavy lines, and other components is desirable, and where unassisted voice communication can be difficult due to noise from wind, waves, and rigging of the boat. The present helmet is also of value in other activities where head protection is important, such as skiing, climbing, etc., and is of value in many occupations as well. The helmet is preferably configured to have smoothly rounded contours devoid of any protrusions, in order to preclude catching or snagging on rigging, tree branches, or other articles during use. The integrated lighting is of great assistance for night sailing, skiing, climbing, or other activities engaged in at night or periods of low lighting. A collar may also be provided, depending from the lower rear edge of the helmet, to protect the wearer from water spray. Preferably, the radio transmitter is voice activated for hands free operation, enabling a sailor, skier, climber, or other user to use both hands for their work. The radio transceiver and battery may be incorporated integrally into the helmet, or may be provided externally and connected to integral earphones and microphone by appropriate cords. Automatic activation and deactivation of the radio circuitry may be provided, thus precluding the radio being left on after removal of the helmet, and depleting any self contained battery power contained integrally with the helmet.

14 Claims, 5 Drawing Sheets

SPORTS SAFETY HELMET

BACKGROUND OF THE INVENTION

1. Field of the Invention

The present invention relates generally to protective headgear, and more specifically to a safety helmet including both two way communication means and integral lighting. The present helmet is particularly well adapted for sailing, with its smooth exterior devoid of protrusions which might otherwise snag in the rigging of a sailing vessel. However the helmet is also well adapted for use in other sports and pursuits where protective headgear incorporating communications and lighting might be needed, such as skiing at night or dusk.

2. Description of the Related Art

It is generally recognized that head injuries are likely the single most serious, dangerous, and potentially life threatening type of injuries which can occur. While the development of relatively high speed motorized sports and activities has resulted in an increase in the potential for such injuries, they may also occur in many other sports and activities as well. Increasing concern for safety has accordingly resulted in the development of specialized helmets for various activities, such as motorcycling, automobile competitions, bicycling, etc. In many types of work, OSHA standards require the use of some form of helmet by workers.

However, while many other activities can pose some risk of head injury to participants, helmets have not been universally accepted in those activities, even though the risk is evident and injury and even death has occurred from time to time in those activities. An example of such is skiing, in which an occasional serious head injury, or possibly even death to the skier, occurs as a result of the skier losing control and inadvertently contacting rocks or trees to the side of a ski run.

Another activity in which a safety helmet may prove to be of value is sailing and other boating activities. While sailing in particular, and boating in general, are quite safe sports, there is nevertheless some chance that serious head injury may occur. The boom of a typical sailing vessel sweeps an arc relatively close to the deck, in order to provide as much sail area and efficiency as possible. While all sailors are aware of the boom, and the arc through which it travels when the boat comes about, it can nevertheless catch a person off guard at times, and may possibly result in serious injury. Even a blow which renders a person unconscious, but does no other damage, can be fatal in sailing if the person is knocked overboard, even with appropriate flotation gear, as the person may not be able to keep their head clear of the water. In addition to the mainsail boom of the typical sailboat, there are a large number of lines and other rigging which may occasionally come loose, and it can be difficult for even an experienced sailor to remain clear of all such rigging in all directions at all times.

Accordingly, a need arises for a specialized sports safety helmet for use in certain special interest sports and activities, such as sailing and other nautical sports, skiing, and other sports which customarily provide little, if any, head protection for participants. The present helmet meets this need by providing a relatively light weight helmet adapted to protect the wearer in relatively low speed impacts (as opposed to heavier helmets used by motorcyclists and in automotive competitions). The present helmet is preferably buoyant in order to support the wearer's head in the water, and includes a face shield to protect the wearer from stray lines, water spray, etc. The present sports safety helmet preferably includes a smoothly rounded and shaped exterior contour, in order to preclude snagging in any lines or rigging typically found in a sailing vessel, or tree branches, etc. which a skier might encounter. The present helmet also preferably includes a voice activated radio transceiver providing communications with other persons on board a boat or yacht where wind and water noise may make conversation impractical on a relatively large and/or fast boat. Integral lighting is also provided for operations at night or dusk. These communications and lighting functions will also be seen to be of value in other sports, such as skiing, skating, etc., where the participant is engaging in the activity at night or dusk, and wishes to maintain contact with others for safety.

A discussion of the related art of which the present inventor is aware, and its differences and distinctions from the present invention, is provided below.

U.S. Pat. No. 4,077,007 issued on Feb. 28, 1978 to Robert D. McKinney, titled "Radio Mounted In A Helmet," describes a helmet having a commercial broadcast radio receiver installed integrally therein. McKinney does not disclose any form of radio transmitter in his helmet, as he provides only for audible entertainment for the wearer of the helmet, rather than for communications. Also, McKinney is silent regarding any form of lighting means with his helmet, either integrated therewith or otherwise.

U.S. Pat. No. 4,130,803 issued on Dec. 19, 1978 to Kenneth L. Thompson, titled "Radio Equipped Protective Helmet," describes a helmet including features similar to those of the McKinney helmet discussed immediately above. Thompson does not disclose any form of radio transmitter in or with his helmet, nor any lighting means in or with his helmet, both of which are provided in the present invention.

U.S. Pat. No. 4,357,711 issued on Nov. 2, 1982 to Joseph Drefko, titled "Two Way Radio Safety Helmet," describes a helmet containing an integral citizens' band radio and power supply. No integral lighting or power supply therefor, is disclosed by Drefko, nor are many of the other features of the present safety helmet, such as buoyancy, a detachable collar, and/or internal antenna to produce a smoothly curved exterior form to preclude catching or snagging on another article, disclosed by Drefko, all of which may be provided in the present invention.

U.S. Pat. No. 4,607,395 issued on Aug. 19, 1986 to James G. Sundahl, titled "Helmet Radio Control Package," describes a radio transceiver which may be removably secured to the exterior of a helmet. A speaker and microphone are secured to the interior surfaces of the helmet in appropriate areas, and are connected to the externally mounted transceiver by appropriate wiring extending around the lower edge of the helmet. Sundahl does not disclose an integrally mounted transceiver and power supply therefor, nor any form of lighting means, either self contained or otherwise, with his helmet and radio.

U.S. Pat. No. 4,638,410 issued on Jan. 20, 1987 to Randall R. Barker, titled "Diving Helmet," describes a helmet having a pair of lights located in the upper portion thereof. No radio transmitter or receiver is disclosed in the Barker helmet, as provided in the present invention.

U.S. Pat. No. 5,207,500 issued on May 4, 1993 to Obdulio Rios, titled "Motorcycle Helmet With Headlights," describes a helmet including repeating lights corresponding to each of the lights on a motorcycle, i. e., head and tail lights, brake light, and turn signals. The helmet is connected to the lighting system of the motorcycle by a power cord, rather than having a self contained power source. At least the turn signals protrude from the forward sides of the helmet, making the Rios helmet unsuitable for use in environments where there is some potential hazard of the helmet catching on another article (boat rigging, tree branches, etc.). No radio transceiver is disclosed in the Rio helmet.

U.S. Pat. No. 5,365,615 issued on Nov. 22, 1994 to Thomas M. Piszkin, titled "Headgear Faceshield W/Non-Invasive Universal Mounting," describes a supplemental eye or face shield which may be added to an existing lightweight helmet. No lighting means or radio transmitter or receiver means is disclosed with the helmet of the Piszkin face shield patent.

U.S. Pat. No. 5,448,780 issued on Sep. 12, 1995 to Ricky J. Gath, titled "Safety Helmet," describes a light weight helmet having an inner liner and outer shell with a space therebetween. A face shield is retractable into the space between the liner and outer shell. While Gath notes that a radio transceiver may be provided with his helmet, the transceiver and. microphone boom are disposed upon the exterior of the helmet, as the retractable face shield leaves little, if any, room to house such components internally, particularly in a relatively light weight helmet such as the Gath helmet. Moreover, Gath is silent regarding any provision for self contained battery power for such a radio, apparently due to the lack of room for such. No lighting or electrical power for such lighting is disclosed by Gath.

U.S. Pat. No. 5,477,566 issued on Dec. 26, 1995 to John C. Massman, titled "Helmet Visor Mechanism With Laterally Moveable Visors," describes a visor system which may be added internally or externally to a helmet. The external embodiment would result in edges and protrusions which could catch on another article, which problem is avoided in the present invention. Massman does not disclose any radio transceiver or lighting means for the helmet.

British Patent Publication No. 1,591,711 published on Jun. 24, 1981 to Sonic Helmets Ltd., titled "Improvements In And Relating To Helmets," describes a supplemental earphone and microphone attachment which may be installed in existing helmets. The disclosure is silent regarding any installation of a radio transceiver or receiver in the helmet, and does not disclose any specific helmet configuration. Also, no mention is made of any lighting means provided with a helmet.

French Patent Publication No. 2,630,603 published on Oct. 27, 1989 to Alain Gentil illustrates a helmet and liner having an integral radio transceiver, ear phones, microphone, and battery power therein. However, no self contained lighting is disclosed with the helmet.

Finally, a 1998 catalog from the Hobie Company describes a helmet specifically designed for sailing. The helmet has a conventional hard plastic outer shell and foam lining, and may be equipped with a retractable face shield. However, no radio communication or lighting means for the helmet is disclosed, as provided in the present helmet invention. While the helmet is stated to be light weight (12 ounces), no statement is made as to its buoyancy or flotation. The buoyant liner of the present safety helmet provides flotation for the helmet.

None of the above inventions and patents, taken either singly or in combination, is seen to describe the instant invention as claimed.

SUMMARY OF THE INVENTION

The present invention comprises a sports safety helmet including two way radio communication means and integral exterior lighting means therewith. The present helmet is particularly well adapted for use in sailing, where wind, wave, and rigging noise may preclude conversation across the deck of the boat, and where some form of integral lighting is virtually essential when sailing at night. However, the helmet is also well adapted for use in other sports where head protection is desirable, such as skiing, climbing and the like.

The present helmet may include an integral two way radio transceiver and batteries therefor, or may include means for connecting the helmet to an external transceiver and battery pack. Preferably, the radio system has a voice activated transmitter, for hands free operation. At least as adapted for sailing, the present helmet preferably includes a liner material of closed cell foam or other buoyant material of sufficient volume to provide flotation for the helmet. A collar may also be provided which may be removably attached to the lower rear edge of the helmet, to protect the wearer from water spray while sailing. Other features, such as automatic activation and deactivation of at least the radio circuitry when the helmet is donned and removed, light beam adjustment means, and a face shield, may also be included with the present sports safety helmet invention as desired.

Accordingly, it is a principal object of the invention to provide an improved sports safety helmet for use in non-motorized or relatively low speed sports and athletic activities where some form of head protection is desirable, such as sailing, skiing, climbing, etc., and where two way communications with others is desirable during the activity.

It is another object of the invention to provide an improved sports safety helmet which may incorporate an integral two way radio transceiver and power supply therefor within the helmet, or which transceiver and power supply may be provided externally to the helmet.

It is a further object of the invention to provide an improved sports safety helmet which radio transmitter may be voice activated for hands free operation.

An additional object of the invention is to provide an improved sports safety helmet including integral external lighting means, with a power supply therefor either contained integrally within the helmet or provided externally to the helmet.

Still another object of the invention is to provide an improved sports safety helmet particularly adapted for sailing and other water sports which is buoyant by means of a light weight and waterproof liner, and which may include a detachable collar depending therefrom to protect a wearer from water spray.

Yet another object of the present invention is to provide an improved sports safety helmet which may include beam width adjustment means for the headlight incorporated therewith, and automatic activation and deactivation means for the radio transceiver incorporated therewith.

It is another object of the present invention to provide an improved sports safety helmet which is smoothly contoured and devoid of protrusions to preclude catching on another article.

It is an object of the invention to provide improved elements and arrangements thereof in an apparatus for the purposes described which is inexpensive, dependable and fully effective in accomplishing its intended purposes.

These and other objects of the present invention will become apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
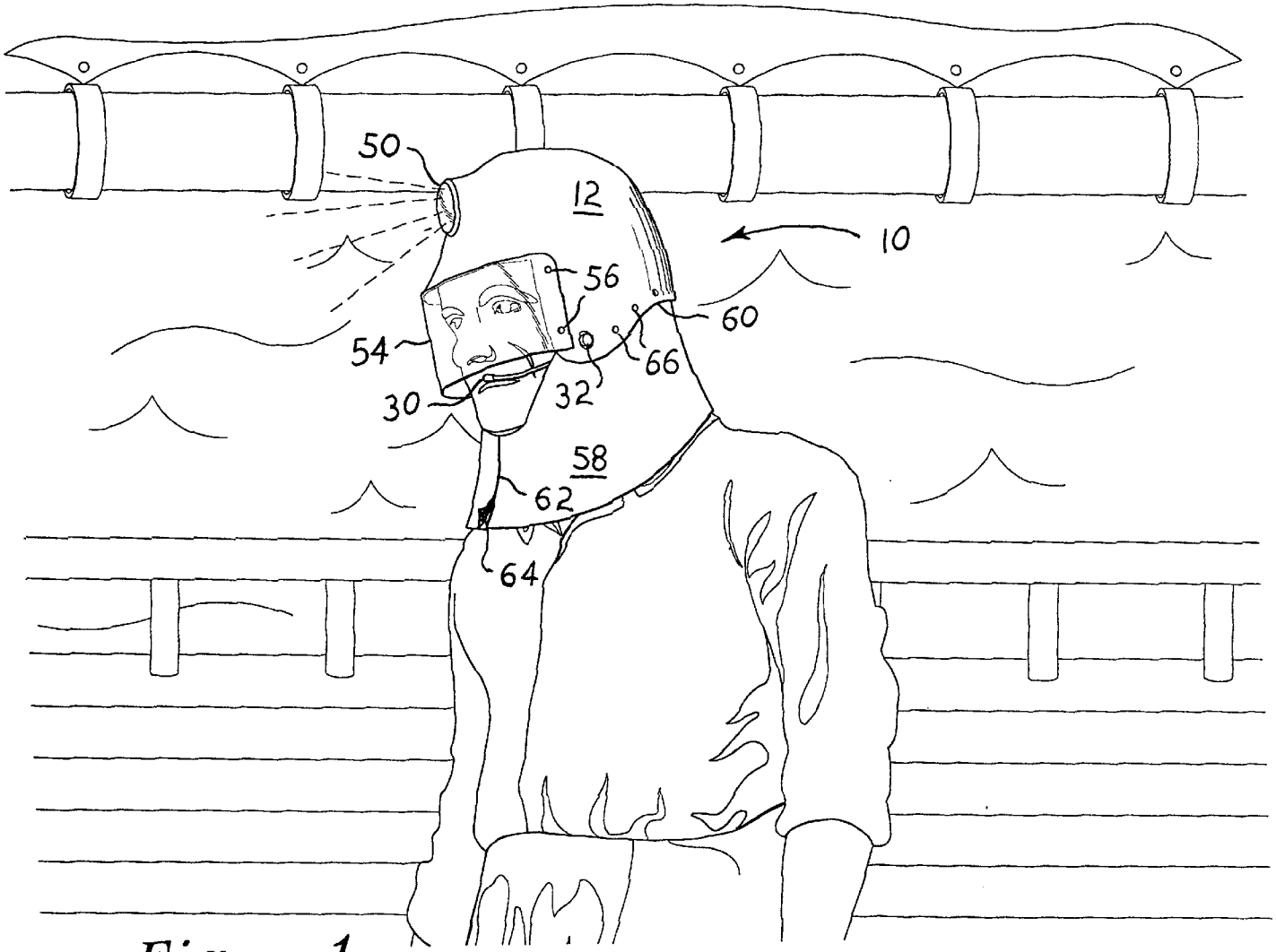
FIG. 1 is an environmental perspective view of the present sports safety helmet in use aboard a sailing vessel, showing some of its various features.

The present invention comprises various embodiments of a sports safety helmet, with a first embodiment 10 shown in FIG. 1. The present helmet 10 and its other embodiments will prove useful in a variety of sports, activities, and occupations, but is particularly well suited for protecting a person's head in sailing, as well as providing lighting and communications.

Figure 3:
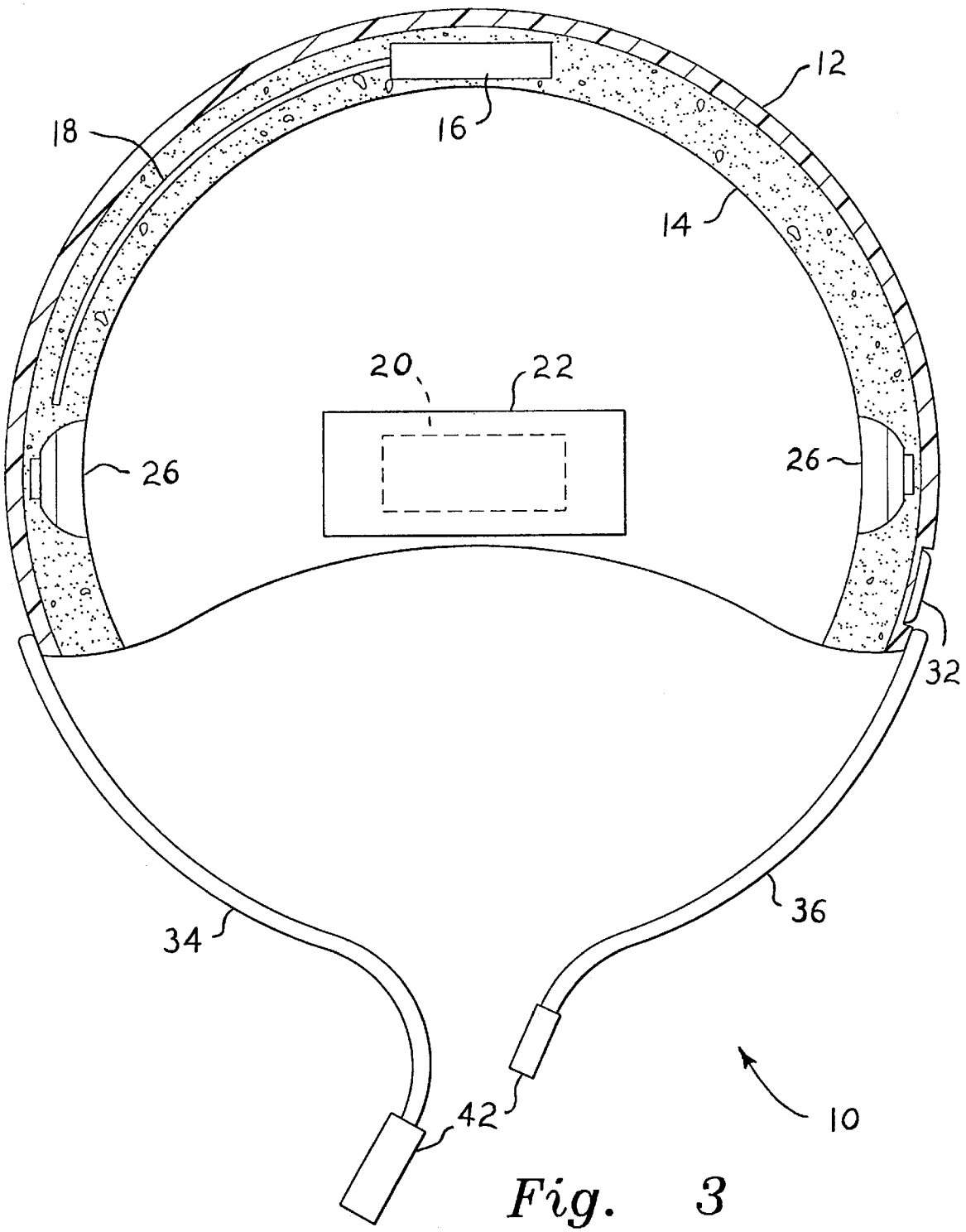
FIG. 3 is a front elevation view in section of the present helmet, showing the internal installation of various electrical and electronic components therein.

The helmet 10 generally comprises a relatively hard and rigid outer shell 12, lined with a relatively soft and resilient inner liner 14 (shown in section in FIG. 3). The outer shell 12 is preferably a plastic material which may be molded or otherwise formed to have a smoothly rounded contour and to be devoid of any significant external protrusions, in order to preclude snagging or catching the helmet 10 on any other articles (boat rigging, tree branches while skiing, cave formations while "spelunking," partially installed wiring in the building trades, etc.).

A cast or molded plastic shell, as used in the construction of "hard hats" in the construction trade, provides sufficient strength and durability for the present helmet embodiments in most of its intended environments of use, as it is not intended that the present helmet be used for protecting the head of a user in high speed motorsports or similar activities. The shell 12 may be formed of other materials, such as a glass fiber matrix, etc. Preferably, the material used is transparent to VHF electromagnetic radiation, as used in the personal communications band in order to provide for a concealed antenna within the helmet 10, as discussed further below. Alternatively, the shell may be formed of a carbon fiber matrix or other RF opaque material and may use an external antenna, as shown in the alternative embodiment helmet 10*a* of FIG. 2. The inner liner 14 material is preferably a soft, resilient, waterproof, buoyant closed cell foam plastic material, in order to provide flotation for the helmet 10 and its other embodiments.

Figure 2:
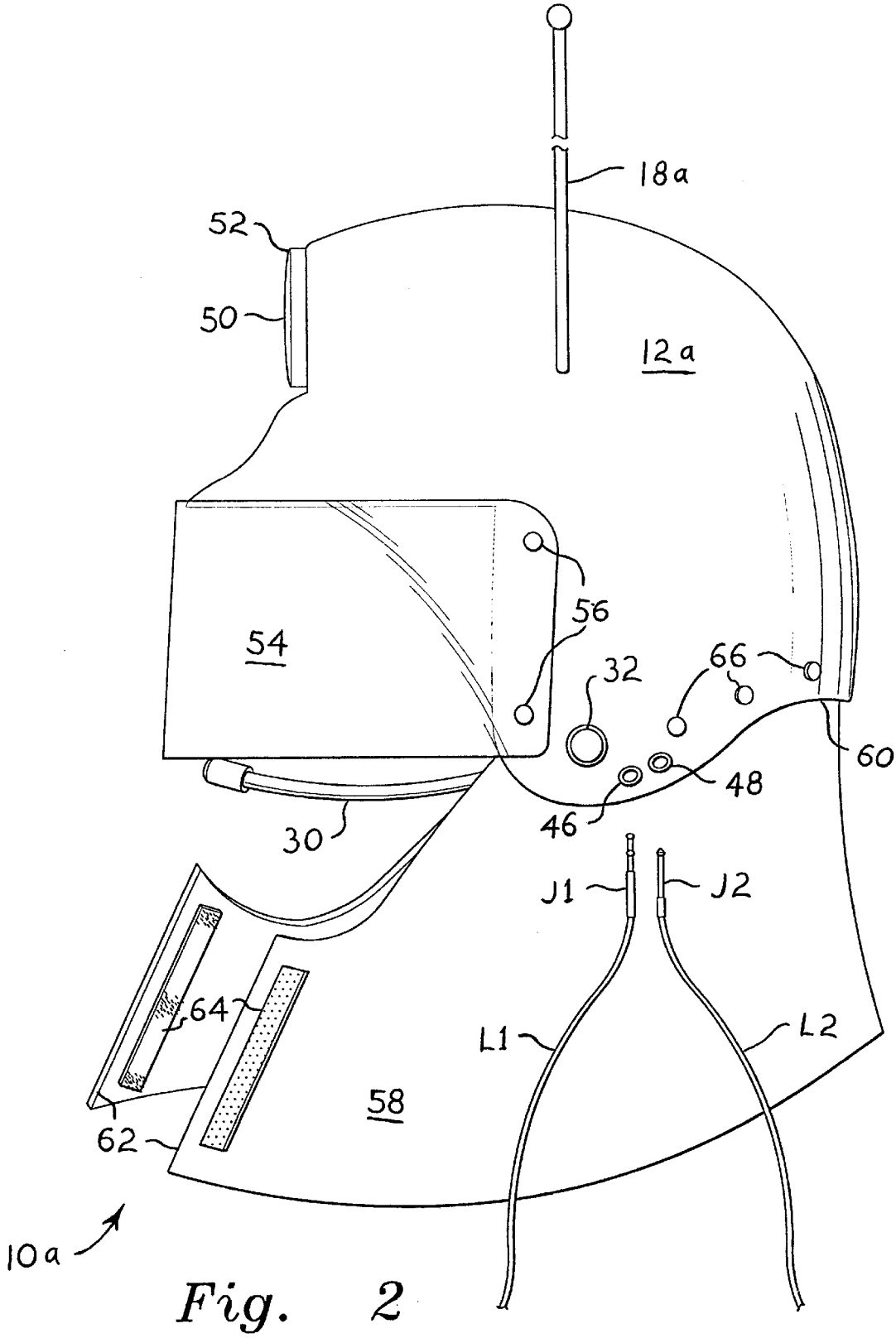
FIG. 2 is a side elevation view of an alternate embodiment of the present helmet, showing further features which may be adapted for use therewith.

The helmet 10 and its other embodiments are equipped to provide two way audible communications between persons wearing such helmets, either by means of a self contained two way radio transceiver within the helmet 10, or by means of an externally disposed transceiver and appropriate connections to the helmet, as in the helmet 10*a* of FIG. 2. The helmet 10 of FIGS. 1, 3, and 4 includes a very small, low powered two way radio transceiver 16 therein (shown in the sectional and schematic views of FIGS. 3 and 4), which may operate in the frequency range or band approved by the Federal Communications Commission (FCC) for such low power FM personal communications devices. Other frequency ranges and operating systems may be used, such as AM CB (Citizens' Band), or as directed by other governing agencies in other nations or jurisdictions. Such low powered radio transceivers are quite small in size, and are capable of transmitting over a relatively short distance. However, such radio transceivers are well suited for use with the present helmet embodiments, e. g., aboard a sailing vessel or the like, where noise from wind and water can mask even shouted communications, particularly over the length of the boat deck, which may extend for several yards or more. Preferably, the radio transceiver 16 utilizes voice activated circuitry, as is known in two way communications devices used with motorcycles, aircraft cockpits, and other environments having high ambient background noise. Such voice activated systems provide hands free operation of the device once electrical power has been activated for the radio. This is most important for most of the operational environments to which the present helmet invention is likely to be applied, i. e., sailing, skiing, climbing, construction work, etc.

Figure 4:
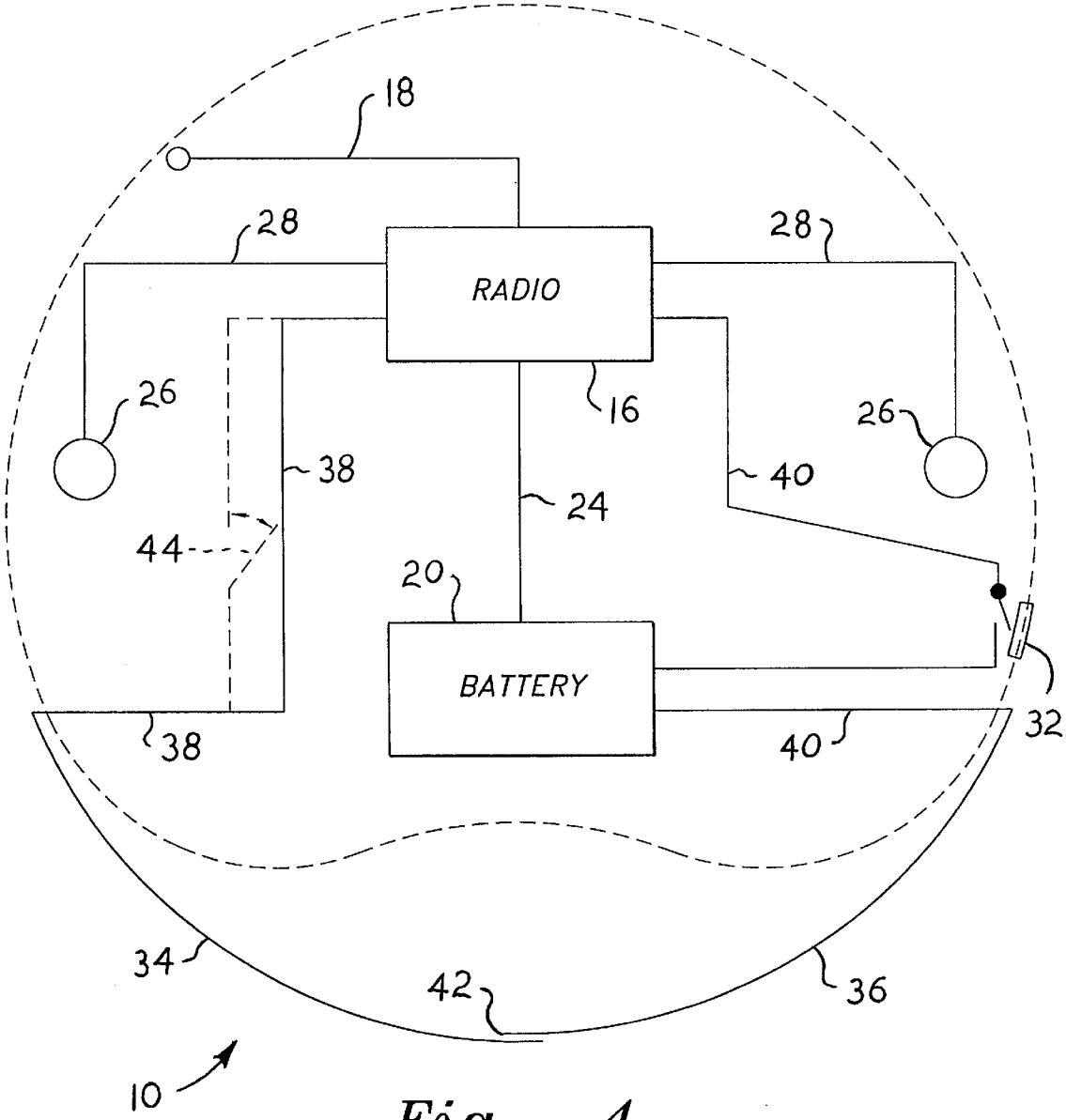
FIG. 4 is a schematic front elevation view of the present helmet, showing the interconnection of various electrical and electronic components therein and alternative activation and deactivation means for the radio therein.

In order to provide the advantages of the smoothly contoured outer shell 12 noted further above, the antenna 18 of the radio 16 may be concealed completely within the plastic shell 12 of the helmet 10, as shown in FIGS. 3 and 4. Alternatively, an external flexible whip antenna 18*a* may be provided for helmets with an outer shell 12*a* which is impervious to radio frequencies, as in the helmet 10*a* of FIG. 2.

FIGS. 3 and 4 schematically illustrate the inclusion of the radio transceiver 16 and other electronic components associated therewith, integrally within the helmet 10. The radio 16 of the helmet 10 of FIGS. 3 and 4 is powered by an integral battery pack. 20, contained within the back of the helmet 10 or elsewhere in the helmet 10, beneath the inner liner 14. (A removable access panel 22 may be provided for access to the batteries 20, for replacement, recharging, etc., with a similar panel, not shown, being provided for access to the integral radio 16.) The battery pack 20 provides power for the radio 16 by means of an electrical line 24, as shown schematically in FIG. 4. The radio 16 in turn provides output to at least one (and preferably two) earphone(s) 26 via speaker output line(s) 28. The earphone(s) 26 is/are imbedded within the inner liner of the helmet in a position(s) adjacent the ear(s) of a wearer of the helmet 10 when it is properly positioned on the wearer's head. Audible input to the radio 16 by the wearer of the helmet 10 is provided by a microphone 30, shown with the helmet 10 of FIG. 1 and helmet 10*a* of FIG. 2.

A voice activated, hands free radio, such as the radio 16 preferably used with the present helmet 10, requires only an on/off switch to control electrical power thereto, once the channel or frequency of operation has been determined and set. Accordingly, an on/off switch 32 may be provided through the outer shell 12 or 12*a* of the helmet 10 or 10*a*. The switch 32 may be an alternating pushbutton switch, wherein one push closes the circuit to activate the radio, and the next push opens the circuit to deactivate the radio.

It will be seen that it is possible that a user of the present helmet 10 or 10*a* could forget to turn off the switch 32 when the helmet 10 or 10*a* is removed, thus depleting the battery 20. Accordingly, alternate automatic switch means may be provided for the present helmet 10 or 10*a,* if so desired. Two such alternative automatic radio switching means are shown in FIG. 4, in addition to the pushbutton switch 32 discussed above.

The present safety helmet 10 or 10*a* is equipped with a chin strap having first and second components 34 and 36 which extend from the edges of the outer shell 12 or 12*a* of the helmet 10 or 10*a,* and secure beneath the chin of the wearer of the helmet 10 or 10*a,* as shown in FIGS. 3 and 4. As the chin strap portions 34 and 36 are always separated from one another when the helmet 10 or 10*a* is removed, the chin strap itself could function as the activation and deactivation switch for the radio 16. By running an electrical lead, respectively 38 and 40, along each of the chin strap portions 34 and 36, and providing an electrical contact point 42 for the leads 38 and 40 when the chin strap portions 34 and 36 are connected together after applying the helmet 10 or 10*a* to the user's head, the electrical connection of the two leads 38 and 40 serve to activate the radio circuit automatically. When the helmet 10 or 10*a* is removed by first disconnecting the chin strap portions 34 and 36, the electrical contact point 42 is opened to deactivate the radio circuit automatically. (The manually operated on/off switch 32 could be eliminated from the circuit if such automatic switching means is provided.)

Another alternative for such automatic activation and. deactivation is by means of a normally open pressure contact switch 44 located within the inner liner 14 of the helmet 10 or 10*a*. When the user of the helmet 10 or 10*a* applies the helmet to his or her head, the pressure of the head within the inner liner 14 could serve to close a pressure activated contact switch 44 within the inner liner 14, thus activating the circuitry for the radio 16. When the helmet 10 or 10*a* is removed from the user's head, pressure is removed from the switch 44, causing the switch 44 to open and thereby open the electrical circuit for the radio 16. (The pressure contact switch 44 circuit is shown as an alternative system in broken lines in FIG. 4.) Again, the manually operated radio system switch 32 could be eliminated with the provision of such an automated radio activation and deactivation means.

Under certain circumstances, it may be desirable to locate the radio and electrical power therefor, externally to the helmet. By placing the electrical power (batteries, etc.) separately from the helmet, a larger power supply may be carried, e. g., in a belt pack or some other convenient location. The radio may also be carried in such a remote location, if so desired. FIG. 2 illustrates such a helmet 10*a,* having provision for an externally disposed radio and battery pack. A first and second receptacle, respectively 46 and 48, are provided in the outer shell 12*a* of the helmet 10*a,* for receiving respective jacks or plugs J1 and J2, which provide electrical connections to and from a remotely located radio and electrical power source by means of their respective leads L1 and L2. Such leads and jacks are well known in the electronics and communications fields, and may comprise a multiple contact jack J1 and multiple conductor lead L1, in order to provide for both transmission and reception from the radio to the helmet 10*a,* and a two conductor jack J2 and lead L2 for providing electrical power and ground for lighting means disposed in the helmet 10*a,* and discussed below. The precise positioning of the two receptacles 46 and 48 is not critical in the present helmet invention, and may be located at any convenient place on the helmet 10*a*. The locations shown in FIG. 2 are exemplary.

Figure 5:
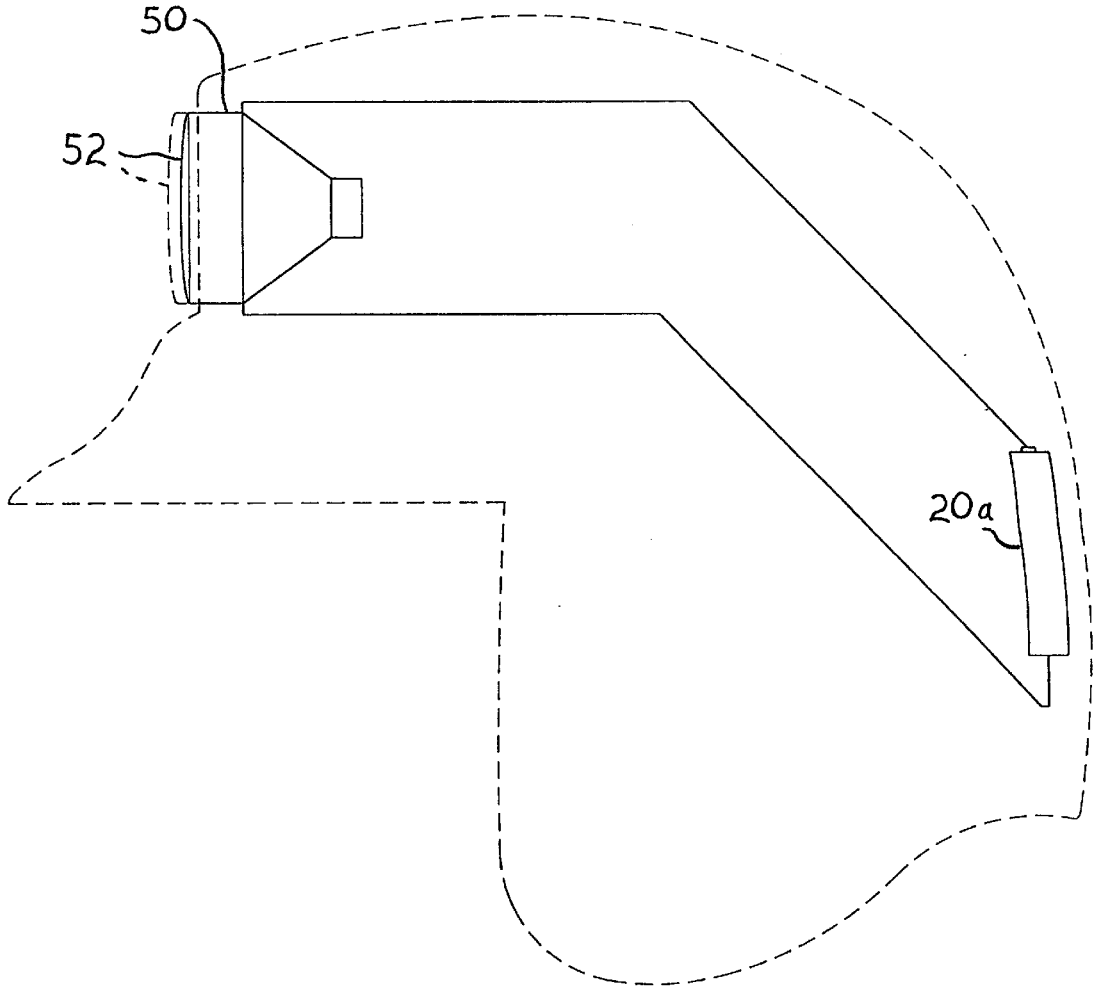
FIG. 5 is a schematic side elevation view of the present helmet, showing the lighting system incorporated therein.

As noted above, the present helmet 10 or 10*a* in any of its embodiments, preferably also includes external lighting means therewith, for operations at night or in other conditions of low lighting. The lighting means preferably comprises a forwardly projecting headlight 50, which is integrated smoothly with the outer shell 12 or 12*a* of the helmet 10 or 10*a*. The light 50 may receive electrical power from a battery or battery pack 20*a,* as shown in FIG. 5, which battery pack 20*a* may comprise the same batteries which provide electrical power for the self contained radio 16 in each of the embodiments, or a separate power supply dedicated solely to the operation of the light 50. The light 50 may include a rotating bezel or rim 52, which may serve as an on/off switch for the light 50, as well as serving to adjust the width or angle of the projected beam between relatively wide and narrow angles. Such mechanisms are known, and need not be described in detail herein.

Preferably, the present helmet 10 and 10*a* embodiments also include a provision for a face shield 54, in order to protect the wearer of the helmet from water spray, wind, etc. The face shield 54 may be removably or permanently secured to the open front of the helmet (and its congruent liner) by means of fasteners 56 (snaps, etc.), with an opposed pair of fasteners also serving as pivot means for the face shield 54 to allow it to be pivoted or swung out of the way of the face as desired by the person wearing the helmet 10 or 10*a*. Such a face shield 54 may be formed as a completely transparent sheet, or may alternatively be tinted as desired in order to reduce light transmission therethrough.

Further protection for a wearer of the present safety helmet 10 or 10*a* may be provided by a flexible collar or balaclava-like extension 58 depending from the inner edge of the lower rear rim 60 of the helmet outer shell 12 or 12*a*. This collar 58 is preferably of sufficient length to drape downwardly over the shoulders and to extend slightly below the back of the neck of the wearer of the helmet 10 or 10*a,* in order to protect the wearer from wind, water spray, etc. The front edges 62 of the collar 58 may be equipped with some form of closure means, such as the mating hook and loop fastener portions 64 (i. e., Velcro, tm) shown in detail in FIG. 2. Other closure means, e.g., snaps, buttons, etc., may be provided as desired. Preferably, the collar 58 is removably attached to the lower rear rim 60 of the helmet 10 or 10*a,* by means of snaps 66 or other suitable securing means, for removal from the helmet 10 or 10*a* when its use is not desired.

In summary, the present sports safety helmet in its various embodiments, provides a much needed improvement in safety and communications in various activities where some potential for head injury exists. The various features of the helmet, i. e., two way communications, lighting, and others, provide significant utility which has not previously been known or developed in such relatively light weight head protective gear. While certain features, e. g., externally disposed radio and battery therefor, have been shown in combination with certain other features, e. g., a collar or balaclava, it should be understood that any such features may be combined in any practicable way with any of the other features of the present helmet invention. For example, an integral radio and electrical power supply may be provided in the helmet, with an external electrical power supply being provided for the headlight and its relatively high electrical power drain, if so desired.

The present safety helmet provide significant advances in safety for sailing, but its utility extends beyond the sailing and boating environments to other activities, such as skiing, climbing, spelunking, and even various occupational activities, such as the building and construction trades, and any activity where users of the present safety helmet might be relatively widely separated and/or in a high ambient noise environment, and a need for verbal communication occurs from time to time. Accordingly, the present safety helmet in its various embodiments will provide a much needed advance in safety, utility, convenience, and efficiency, in a variety of sports and occupational activities.

It is to be understood that the present invention is not limited to the embodiments described above, but encompasses any and all embodiments within the scope of the following claims.

We claim:

1. A sports safety helmet, comprising:

a hard outer shell;

a resilient inner liner formed of a waterproof material;

a radio transceiver disposed within said outer shell;

at least one earphone and a microphone disposed within said outer shell, respectively for receiving signals from said transceiver and transmitting signals by means of said transceiver;

means for automatically activating and deactivating at least said transceiver when said helmet is respectively donned by a user and removed from the head of the user; and a forwardly projecting headlight integrated with said outer shell.

2. The sports safety helmet according to claim 1, including electrical power means integrally disposed within said outer shell.

3. The sports safety helmet according to claim 1, wherein said outer shell is smoothly contoured and devoid of significant protrusions extending therefrom, for precluding catching and snagging of said outer shell on other articles.

4. The sports safety helmet according to claim 1, wherein said outer shell includes a lower rear rim having a collar detachably depending therefrom, for protecting a wearer from water spray.

5. The sports safety helmet according to claim 1, wherein said outer shell and inner liner each include an open front having a transparent face shield removably extending thereacross.

6. The sports safety helmet according to claim 1, wherein said headlight projects a beam having a width, and including means for adjusting said width of said beam.

7. The sports safety helmet according to claim 1, wherein said automatic activation and deactivation means for said transceiver comprises first and second chin strap components extending from said outer shell, with said chin strap components each including electrical connection means therein for closing a transceiver activation electrical circuit when said chin strap components are connected, and for opening said transceiver activation electrical circuit when said chin strap components are disconnected.

8. The sports safety helmet according to claim 1, wherein said automatic activation and deactivation means for said transceiver comprises a normally open electrical contact switch disposed within said inner liner, with said contact switch closing a transceiver activation electrical circuit when pressure is applied by the head of the user when said helmet is donned, and with said contact switch opening said transceiver activation electrical circuit when pressure is released as said helmet is removed from the head of the user thereof.

9. A sports safety helmet, comprising:

a hard outer shell;

a resilient inner liner formed of a waterproof material;

a radio transceiver removably disposed externally of said outer shell:

radio transceiver connection means disposed within said outer shell, for connecting said radio transceiver thereto;

at least one earphone and a microphone disposed within said outer shell, respectively for receiving signals from the transceiver and transmitting signals by means of the transceiver;

means for automatically activating and deactivating at least said transceiver when said helmet is respectively donned by a user and removed from the head of the user; and a forwardly projecting headlight integrated with said outer shell.

10. The sports safety helmet according to claim 9, including electrical power connection means disposed within said outer shell, for removably connecting an external electrical power source for said headlight.

11. The sports safety helmet according to claim 9, wherein said outer shell is smoothly contoured and devoid of significant protrusions extending therefrom, for precluding catching and snagging of said outer shell on other articles.

12. The sports safety helmet according to claim 9, wherein said outer shell includes a lower rear rim having a collar detachably depending therefrom, for protecting a wearer from water spray.

13. The sports safety helmet according to claim 9, wherein said outer shell and inner liner each include an open front having a transparent face shield removably extending thereacross.

14. The sports safety helmet according to claim 9, wherein said headlight projects a beam having a width, and including means for adjusting said width of said beam.

* * * * *